US005203626A

United States Patent [19]

Clement

[11] Patent Number: 5,203,626

[45] Date of Patent: Apr. 20, 1993

[54] LOW VOLTAGE POWER DISTRIBUTION AND LIGHTING SYSTEM

[76] Inventor: Wade Clement, 460 Brannan, San Francisco, Calif. 94107

[21] Appl. No.: 710,066

[22] Filed: Jun. 4, 1991

[51] Int. Cl.[5] ..... F21V 21/14

[52] U.S. Cl. ..... 362/250; 362/396; 362/427; 362/454; 362/455

[58] Field of Search ..... 362/226, 249, 250, 147, 362/404, 408, 427, 396, 366, 239, 454, 455

[56] References Cited

U.S. PATENT DOCUMENTS 4,688,154 8/1987 Nilssen ..... 362/147
4,751,627 6/1988 Usher ..... 362/250 X
4,837,667 6/1989 Grau ..... 362/147

FOREIGN PATENT DOCUMENTS 2759114 7/1979 Fed. Rep. of Germany ..... 362/396

*Primary Examiner*—Stephen F. Husar

[57] ABSTRACT

A modular low voltage power distribution and lighting system that contains a series of components that allow easy installation by means of these compatible modular components to provide low voltage power, less than 30 volts, throughout a given space. The system is based on the use of one or more transformers providing electrical power to one or more electrical circuits running through a series of compatible tubular fixture housings, and related components, to a series of female receptacles located at predetermined locations along the outside surface of the tubular fixture housing. The system may incorporate one or more lampholder devices that attach to the tubular fixture housing and obtain low voltage power from any of the female receptacles. The lampholders contain a series of rings that retain the lamp and accessories by means of flat rings held under pressure in slotted plates between the arms of the lampholder frame.

20 Claims, 3 Drawing Sheets

Figure 8:
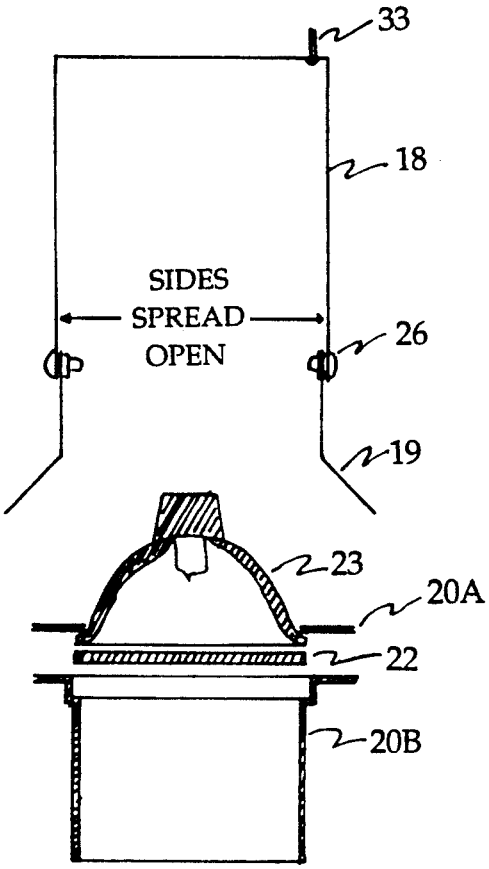

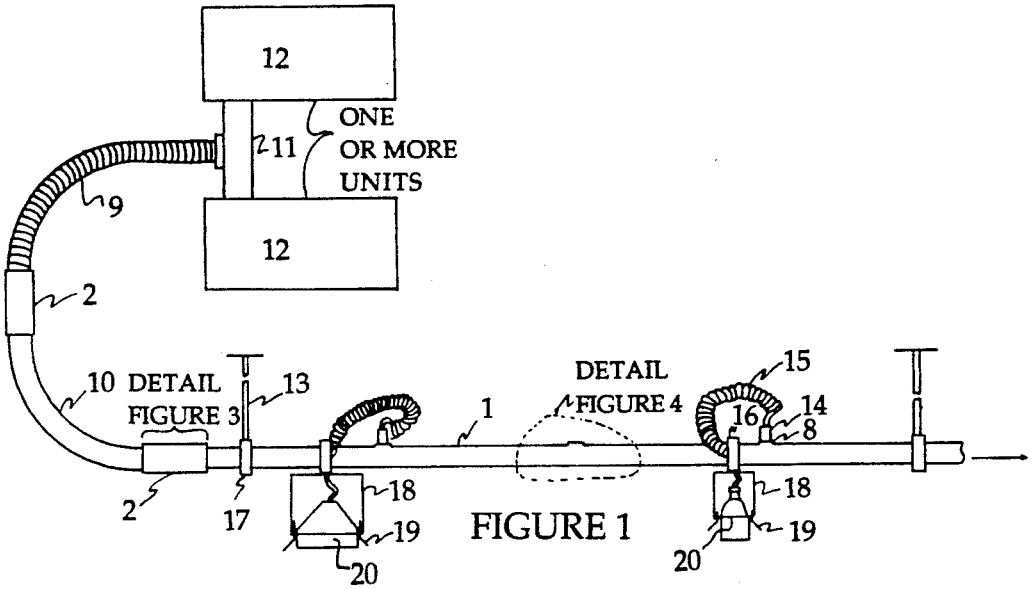
FIGURE 1
FIGURE 2
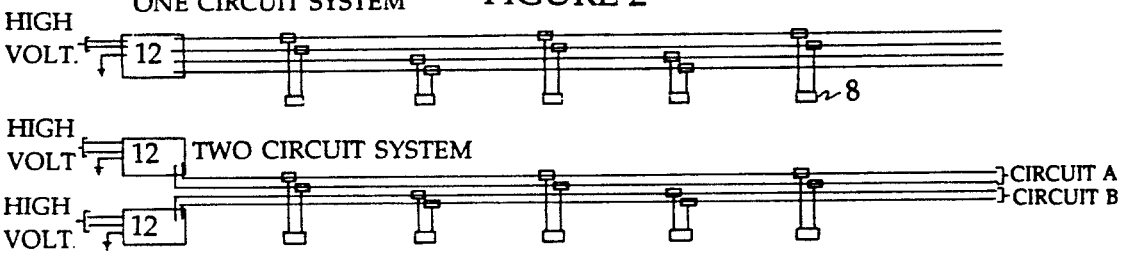
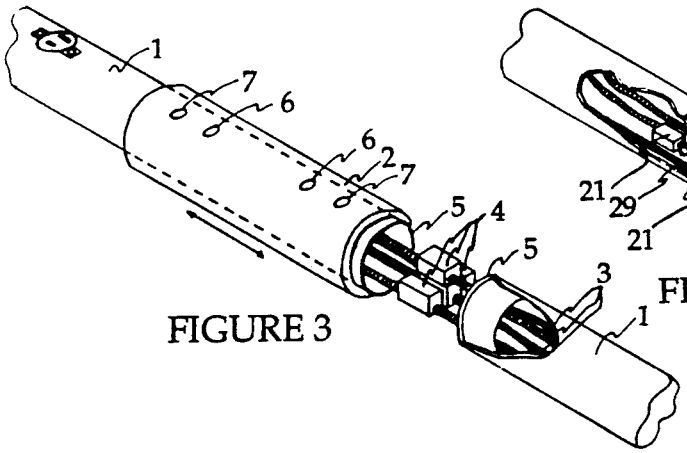
FIGURE 3
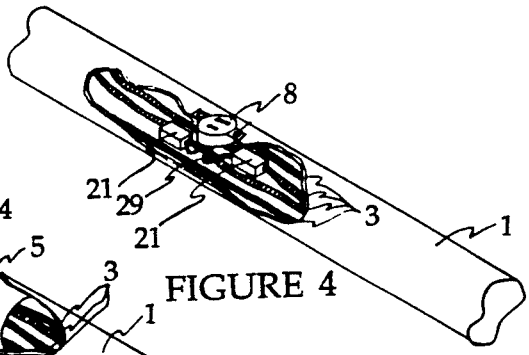
FIGURE 4

LOW VOLTAGE POWER DISTRIBUTION AND LIGHTING SYSTEM

BACKGROUND

Field of the Invention

This invention relates to low voltage power distribution systems for any purpose, such that it may be classified as "track", which is generally used at high or mains voltage. This invention incorporates within its scope of usefulness the ability to function with a variety of lampholders such as are incorporated in this invention, or existing art lampholders that may be adapted to fit. Therefore the invention may be considered in whole, or any of the identified parts to be a track lighting system, but is not necessarily limited to being used for lighting purposes. As considered a track lighting system its primary function is for display and accent lighting, but it is not limited to these uses.

Background and Description of Prior Art

Historically, flexible lighting systems such as track were limited to high or mains voltage, such as 120 volt, that utilized 120 volt lamps. In the past decade there has been a vast increase in lamp technology that utilizes low volt design, low voltage being under 30 volts. As the lighting industry has attempted to to adapt to the increasing demand for low voltage lamps manufactures have created lamp holders that would reduce the voltage at each individual lamp, rather than attempt to create a completely new design. There are many challenges in using the previous approach, the high volt distribution system is adequate but the lampholders are generally prone to regular component failures due to the extreme heat build up with the lamp and transformer being in the same housing. There also tends to be quite a bit a noise, generally humming, that is created by the use of the small transformers used in the high volt systems.

To address these problems it seemed necessary to design a system that would allow the use of much larger and more reliable transformers that would be placed in remote locations, such as a cabinet, closet, or ceiling. Remotely locating the transformers moves the heat and noise generated by the transformer(s) to a location that is not a nuisance. Existing art for low voltage distribution: U.S. Pat. Nos. 4,776,809, S Hall; 4,837,667, T Grau. The design by Hall is based on using an expensive to produce series of extrusions and lacks flexibility in installation. The design by Grau is based on an exposed pair of conductors that are structurally and requires that it be tensioned between two surfaces. Neither of these systems are capable of being mounted suspended from the ceiling, nor is either system capable of being wired for more than one control circuit.

Upon setting out to accomplish this task it became obvious that there were many considerations that must be met:

The major difficulty in low voltage power distribution is overcoming the tendency of power drop (voltage drop) in the distribution system while maintaining a high wattage, or current, capacity. This is overcome by using multiple conductors to increase the conductor area for wattage capacity and/or to provide multiple circuit control.

The next challenge was to design a series of components that would be modular for maximum design flexibility at a minimum tooling and production cost. This was accomplished by using standard (previous art) components, whenever possible, that are used as made, or are modified to accomplish the task.

The next challenge was to design an electrical splice joint that is capable of handling the high currents inherent to low voltage, without oxidation, and within the space constraints of the visual qualities of the design. It was also necessary to design the splice joint so that it could be made by an experienced electrician without special tools, and would also support the structure of the housing across the splice. The difficulties of the joint were overcome by using a retractable sleeve that would not interfere with the splicing of the conductors, the splices could be made using existing art electrical connectors such as crimp style or set screw style (typically called euro style) connectors. Once the electrical splice was accomplished the sleeve would be moved over the area of the joint and locked onto both tube sections providing a suitable mechanical connection of the housings.

The final challenge in the power distribution was having access to the current in the conductors running through the housing of the system. This was accomplished by using a tap or splice that may be mechanical or soldered to supply female receptacles that would be located in the wall of the fixture housing at predetermined locations. The receptacles would be wired into alternate sets of wires so that every other receptacle would be fed from a different, or alternate circuit, such as when the system is wired with two or more transformers. This is useful in many applications, particularly when different light levels are desired by way of dimming.

Once the challenge of distributing the power over a large area was accomplished it was then necessary to design a series of appropriate lampholders that would be attachable to the power distribution system's housing, in this case the tubing. These fixtures generally utilize existing art clamps and coiled electrical cords that attach to the tubing to provide a basis from which a lampholder may be attached. Coil cords were chosen for flexibility in length and their ability to self maintain, so as not to create the hazard of stray wires.

The biggest challenge was to design versatile lampholders that would require the least number of components and would also allow the most flexibility to the end user. The other major consideration was the heat given off by the lamps that would be used, typically tungsten halogen, which create high temperatures in a small space. Previous art: see U.S. Pat. Nos. 4,760,509 and 4,703,404 both by Helton & Panagiotou. In these lampholders the fixtures are quite elaborate and require many difficult to fabricate parts, which increases design, tooling and production costs. These lampholders are also limited in their ability to accept accessories that are required to effectively control the beam emitted from the lamps.

As a result the lampholders were designed to utilize a "U" shape yoke frame that would spread open and spring back to allow the insertion and removal of the components, typically rings. These rings would be the basis of the lampholder's function. The rings would retain the safety glass explosion shield and the lamp.

The lampholders were designed to accept a wide range of accessories such as colored filters and louvers. They were also designed to retain a glass cover that would provide a safety shield in the event of the explosion of one of the lamps.

Another challenge was to be able to overcome the heat build up that typically causes failure of lampholder components. This was accomplished by making the rings open whenever possible, as long as it did not leave the electrical contacts exposed. In one instance the open rings are reversible to provide a snooted or open front. Using the least amount of material and having as many openings as possible increases the cooling capacity of the lampholder.

OBJECTS AND ADVANTAGES

The solutions to the previously discussed challenges has yielded a low voltage power distribution and lighting system with many advantages.

The advantage of placing the transformers in a remote location are many. Such as: being able to locate unsightly components of the system so that the noise and heat are located away from the area of heavy use. Remotely locating the transformers allows the use of heavy duty transformers that are less likely to burn out than smaller transformers that are generally incorporated lampholder for low voltage lamps. Remote location of the transformer(s) allows for more creative visual design of the lampholders. As a result the lampholders may be made much smaller than previously possible since there is no need to allocate space for the transformer within the lampholder body.

The system is designed, but not limited to, being powered by multi volt transformers. Using a slightly higher voltage than the specification of the lamps allows the system to compensate for volt drop over long distances, and therefore allows the lamps to operate at peak output.

The advantage of producing the power distribution portion of the system out of pre-existing components such as tubing, wire and receptacles greatly reduces the set-up and production costs. Using round tubes also allows the system to be designed with the fewest number of component choices. Round tubing allows the joints to be turned in an unlimited number of plains. The round tubing may also be bend or rolled into an unlimited number of shapes (arcs, s curves) prior to fabrication. The flexible tubing allows for the formation of any angle on the site of installation.

The lampholders have many advantages that are unique. The primary feature is the use of rings that mount face to face and sandwich the lamp and various accessories and or safety guards. In certain cases these rings may be reversed so that the functional or visual aspects of the fixture may be changed without the use of additional parts. The lampholders may also be positioned in such a way as to permit up-lighting, which is not possible with conventional lighting systems as they do not pendant mount and allow the fixtures to be pivoted around the round tube. The lampholders are also capable of being adjusted on three different pivot points that may be adjusted and set without the use of any tools.

DRAWING FIGURES

FIG. 1 Overall view of system illustrating potential but not limited configuration.

FIG. 2 Schematic diagrams showing 2 potential circuits of typical 4 wire construction.

FIG. 3 View of splice joint and sleeve, opened to allow electrical connections to be made.

FIG. 4 Cut away view of typical electrical tap to supply female receptacle in fixture housing.

Figure 5:
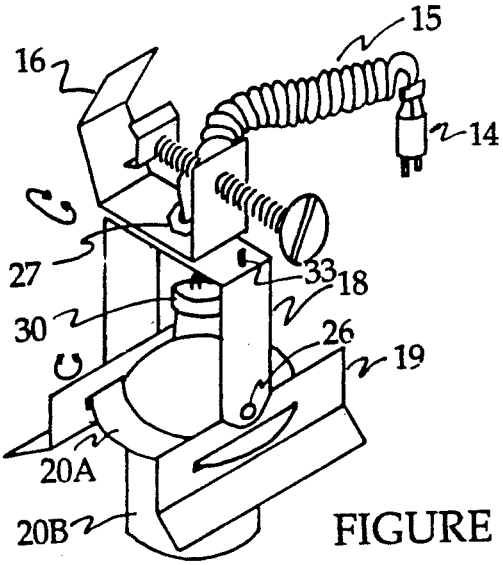

FIG. 5 Isometric view of small lampholder.

Figure 6:
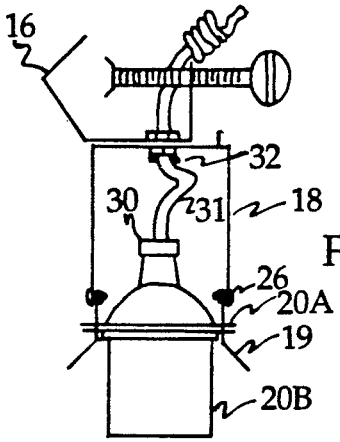

FIG. 6 Small lampholder assembled with glare cutoff snoot toward front.

Figure 7:
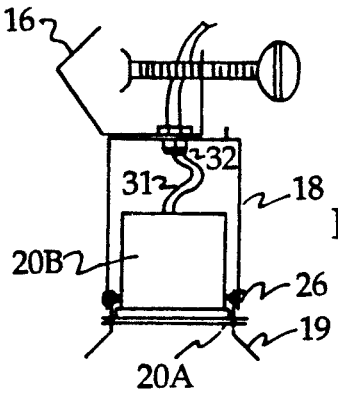

FIG. 7 Small lampholder assembled with glare cutoff snoot rear.

FIG. 8 Small lampholder, cut away view of lamp, rings and glass shatter guard.

Figure 9:
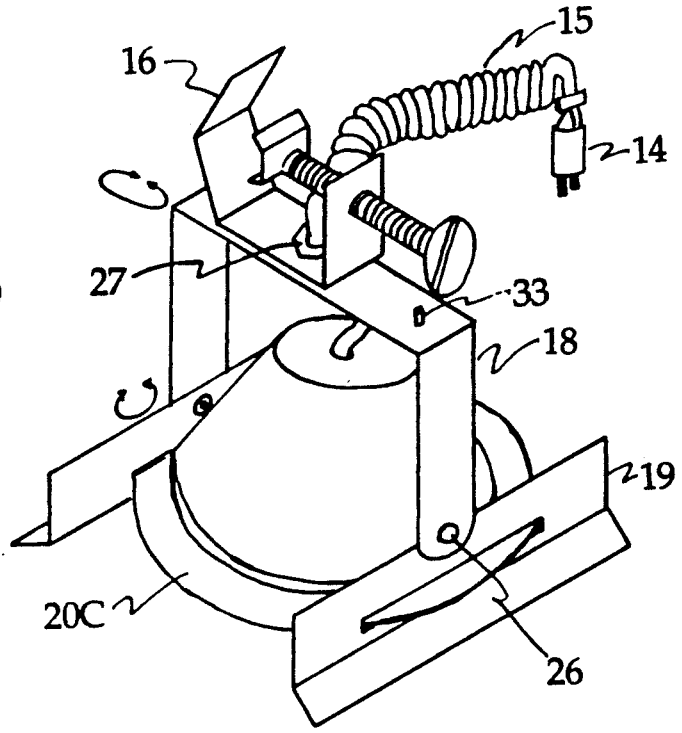

FIG. 9 Isometric view of large lampholder.

Figure 10:
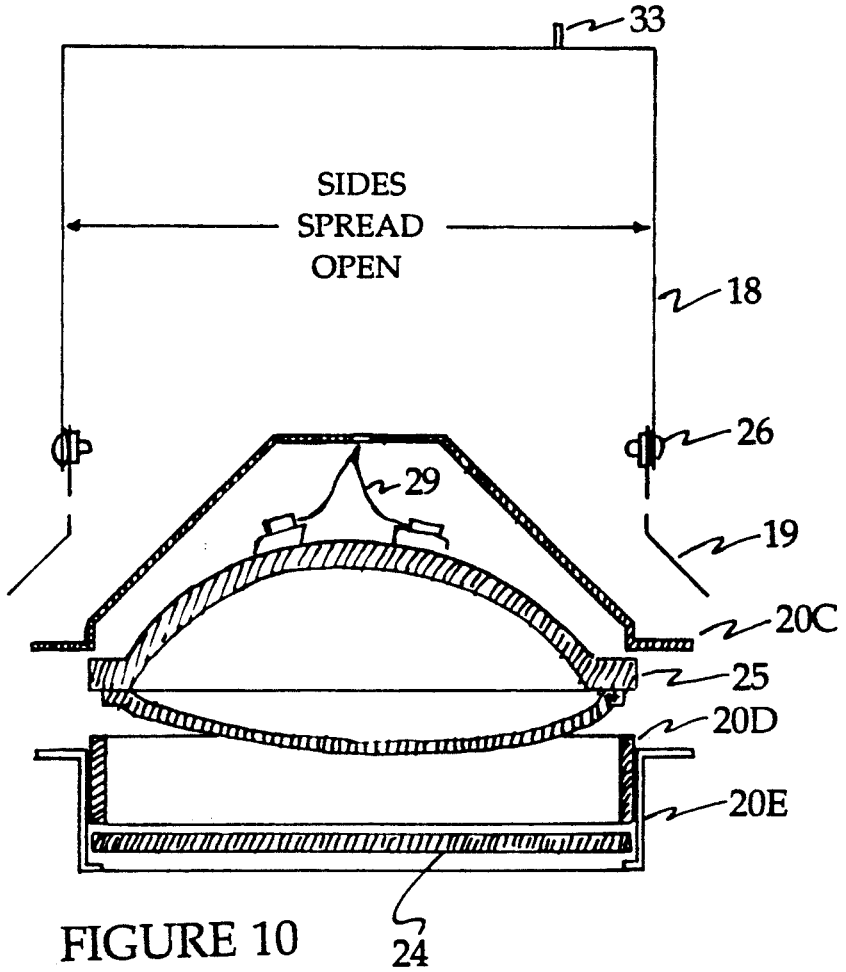

FIG. 10 Large lampholder, cut away view of lamp, rings and glass shatter guard.

REFERENCE NUMERALS IN DRAWINGS

1) Metal or plastic tubing (fixture housing) may be bent or cut to size.
2) Metal or plastic sleeve joint.
3) Conductors, generally insulated wire.
4) Electrical splices, may be mechanical with screws (euro style wire connectors) or crimp on, etc.
5) Plastic insulating bushing
6) Sight alignment holes.
7) Set screws to lock sections of tube together (fixture housing).
8) Female electrical receptacle.
9) Flexible metal or plastic tubing.
10) Preformed metal or plastic tubing.
11) Junction box or tee (for use when using two transformers, or when center feeding tubing sections with electrical power)
12) Transformer(s), single or multi volt output.
13) Mounting stems or brackets (cut to length).
14) Male electrical plug.
15) Recoiling electrical cord.
16) Screw clamp.
17) Tube clamp for mounting stems.
18) Frame.
19) Slotted side plates.
20) Lampholder rings
20A) Small fixture flat ring.
20B) Small fixture snooted ring.
20C) Large fixture back ring.
20D) Large fixture spacer ring.
20E) Large fixture front ring.
21) Electrical tap or splice, mechanical or soldered connection.
22) Small fixture glass shatter guard.
23) Small lamp, typically MR16 or equivalent style.
24) Large fixture glass shatter guard.
25) Large lamp, typically PAR 36 or equivalent style.
26) Rivet, washer and spring tension washer assembly.
27) Hex nipple, nut and spring tension washer assembly.
28) Blind rivet.
29) Small wire lead(s).
30) Lamp socket.
31) Insulating sleeve (wire protector).
32) Strain relief.
33) Stop pin.

DESCRIPTION

This invention is a low voltage power distribution and lighting system.

A typical installation may be illustrated in FIG. 1. In this configuration there are one or more multi volt transformers (12) which convert the high voltage, usually in the United States is 120 volt, to low volt power, typically 12 or 24 volts. The insulated conductors (3) feed the electrical power through the tee joint (11) into the flexible fixture housing or tube (9, 10, 1). These transformer(s) (12) may be installed in a remote location out of the view and hearing of where the system will actually be operating. The low volt electrical power is fed through insulated conductors (3) inside the fixture tube (1) to receptacles (8) located along the length of the tubular fixture housing (1).

Joining the various components of a typical system (such as to join #'s 1, 9, 10) is facilitated by means of a mechanical and electrical splice joint FIG. 3. In FIG. 3 the various components, whether straight or bent, are electrically connected by means of mechanical electrical splices (4) that join the conductors (3) to make a solid electrical connection. A mechanical bond between the two fixture housings (1, 9 or 10) is made with the joint sleeve (2) by moving it into position over the electrical splices (4). By looking through the two sight alignment holes (6) for overlap on the housings (1, 9, or 10) then tightening the two set screws (7) the two fixture housings (1, 9 or 10) are securely joined.

Typically the tube sections (1, 9 or 10) are suspended from the structure by way of mounting stems and tube clamps (13, 17), but may also be cantilevered out away from a structure by utilizing the structural integrity of the tubular fixture housing (1), or an independant bracket.

A variety of installations may be made by bending (rolling) the fixture housing (1) before fabrication to fit the installation, using pre-bent corners (10), or flexible tubing (9) of any length.

Once the power distribution system (1, 2, 9, 10, 11, 12, 13, 17 and all components contained within) is installed it is possible to locate lampholders (such as FIGS. 5 and 9) anywhere along the length of the fixture tube (1) and to insert the male plug (14) into a pre-located fixture receptacle (8) to gain access to electrical power.

The lampholders (FIGS. 5 and 9) may be focused, or aimed, to fulfill the needs of the application. This is accomplished by adjusting the fixtures on the three different axis. The first axis is created when the clamp (16) is secured around the fixture tube (1), and may be rotated without limitation around the tube. The second axis point is accomplished with the joint held together by the Hex nipple, nut, and spring tension washer (27) between the clamp (16) and the frame (18). This nut and nipple are bonded with a locking adhesive. This joint has a limited movement provided by the stops (33) to prevent the electrical cord (15, 31) from being twisted. The third axis is created by the joining of the frame (18) and the slotted side plates (19). This axis is secured with the use of a pressure rivet. reinforcing washer and a spring steel tension washer (26). By utilizing the spring tension washers in the assembly of the joints (26, 27) the joints will move freely but will also maintain the chosen position.

Both lampholders (FIGS. 5, 9) retain the lampholder rings (20A Through 20E) by inserting the rims of the rings (20A through 20E) into the slots of the slotted side plates (19). Inward pressure from the frame (18) retains the rings (20A through 20E) between the slotted plates (19).

The small lampholder (FIGS. 5, 6, 7, 8) encloses a lamp (23) within the reversible ring assembly (20A, 20B) and the glass shatter guard (22) and allows the installer to choose whether they want a flush or snoot front to reduce glare, or flare, on either end of the lamp by reversing the order of the assembly of the rings (20A, 20B), (FIG. 6 versus FIG. 7) without the use of any additional parts. The open back of the lampholder allows the fixture to operate at a cooler temperature.

The large lampholder (FIGS. 9, 10) is designed to enclose PAR 36 and AR111 lamps by securing the lamp (25) by the outer rim between the rings (20C, 20D, 20E) and behind the glass explosion guard (24).

This system is in no way is limited to only this configuration. The nature of the modular construction allows the major system components to be assembled in an unlimited variety of configurations.

I claim:

1. A distributed lighting system, including;

at least one tubular support member;

conductor means secured within said at least one tubular member and connected to an electrical power source;

a plurality of power connector receptacles secured in said at least one tubular member and opening outwardly therefrom, said plurality of power connector receptacles being connected to said conductor means, said plurality of power connector receptacles being spaced apart along said at least one tubular member;

a plurality of lamp holder fixtures, each including an electrical lamp;

each of said lamp holder fixtures including clamping means for removably securing the respective lamp holder fixture to said at least one tubular member at any location therealong; said clamping means being securable to said at least one tubular member at any rotational angle with respect to the tubular axis of said at least one tubular member;

each of said lamp holder fixtures including extendible cable means for connecting the respective lamp holder fixture to one of said power connector receptacles.

2. The distributed lighting system of claim 1, further including a plurality of said tubular support members, joint means for joining said plurality of tubular support members in mechanical union end to end, and splicing means for connecting said conductor means of said plurality of tubular support members within said joint means.

3. The distributed lighting system of claim 2, wherein said joint means includes a plurality of tubular sleeves, each dimensioned to be received concentrically about confronting ends of adjacent tubular members, and means for securing each of said tubular sleeves to said confronting ends.

4. The distributed lighting system of claim 1, wherein said conductor means includes a plurality of conductors connected to at least one low voltage power source, and said power connector receptacles comprise female electrical receptacles connected to said conductors.

5. The distributed lighting system of claim 1, wherein said plurality of conductors are connected to define two distinct low voltage circuits, and said power connector receptacles are grouped into two groups, each of said groups connected to a respective one of said two low voltage circuits.

6. A distributed lighting system, including;

at least one lighting support member;

conductor means secured within said at least one lighting support member and connected to an electrical power source;

a plurality of lamp holder fixtures, each including an electrical lamp;

each of said lamp holder fixtures including means for connecting the respective lamp holder fixture to said conductor means;

each of said lamp holder fixtures including means for removably securing the respective lamp holder fixture to said at least one lighting support member;

each of said lamp holder fixtures including a rear housing member enclosing a portion of said lamp, said rear housing member including a first flange extending outwardly therefrom; a tubular housing member having a second flange extending outwardly therefrom; and means for releasably securing said rear housing member and said tubular housing member together with said first and second flanges in confronting, abutting relationship.

7. The distributed lighting system of claim 6, wherein said means for releasably securing includes a frame member having a pair of opposed arms that are resiliently spreadable.

8. The distributed lighting system of claim 7, further including slot means associated with each of said opposed arms for engaging and securing said first and second flanges in abutting relationship.

9. The distributed lighting system of claim 8, wherein said slot means includes a pair of plates, each secured to one of said opposed arms and each including a slot disposed therein and dimensioned to receive said first and second flanges in abutting, confronting registration.

10. The distributed lighting system of claim 9, wherein each of said plates is joined to the respective arm in rotatable relationship.

11. The distributed lighting system of claim 6, wherein said tubular housing member includes a tubular portion having a diameter greater than the diameter of said rear housing member and adapted to be variably positionable with respect to said rear housing member from a first position concentrically about said rear housing member with said first and second flanges in abutting, confronting relationship to a second position extending adjacent to said rear housing member with said first and second flanges in abutting, confronting relationship.

12. The distributed lighting system of claim 7, wherein said means for removably securing includes a clamp assembly joined to said frame member.

13. The distributed lighting system of claim 6, further including a transparent safety shield disposed between said first and second flanges.

14. A lighting fixture, including an electrical lamp, a rear housing member enclosing a portion of said lamp, said rear housing member including a first flange extending outwardly therefrom; a tubular housing member having a second flange extending outwardly therefrom; and means for releasably securing said rear housing member and said tubular housing member together with said first and second flanges in confronting, abutting relationship.

15. The lighting fixture of claim 14, wherein said means for releasably securing includes a frame member having a pair of opposed arms that are resiliently spreadable.

16. The lighting fixture of claim 15, further including slot means associated with each of said opposed arms for engaging and securing said first and second flanges in abutting relationship.

17. The lighting fixture of claim 16, wherein said slot means includes a pair of plates, each secured to one of said opposed arms and each including a slot disposed therein and dimensioned to releasably secure said first and second flanges in abutting, confronting registration.

18. The lighting fixture of claim 17, wherein each of said plates is joined to the respective arm in rotatable relationship.

19. The lighting fixture of claim 14, wherein said tubular housing member includes a tubular portion having a diameter greater than the diameter of said rear housing member and adapted to be variably positionable with respect to said rear housing member from a first position concentrically about said rear housing member with said first and second flanges in abutting, confronting relationship to a second position extending adjacent to said rear housing member with said first and second flanges in abutting, confronting relationship.

20. The lighting fixture of claim 14, further including a transparent safety shield disposed between said first and second flanges.

* * * * *